United States Patent [19]

Dageford

[11] 4,261,179

[45] Apr. 14, 1981

[54] INPUT CONTROL SYSTEM

[75] Inventor: Ernest Dageford, Irvine, Calif.

[73] Assignee: Ardco, Inc., Chicago, Ill.

[21] Appl. No.: 944,798

[22] Filed: Sep. 22, 1978

Related U.S. Application Data

[63] Continuation of Ser. No. 878,332, Feb. 16, 1978, abandoned, which is a continuation of Ser. No. 718,804, Sep. 1, 1976, abandoned.

[51] Int. Cl.[3] ..... F25D 21/00

[52] U.S. Cl. ..... 62/150; 62/140; 62/248; 62/275; 73/336.5

[58] Field of Search ..... 62/140, 275, 176 A, 62/248, 150; 73/17 A, 336.5; 340/235; 307/DIG. 1

[56] References Cited

U.S. PATENT DOCUMENTS

| | | | |
|---|---|---|---|
| 3,195,344 | 7/1965 | Francisco | 73/17 A |
| 3,460,352 | 8/1969 | Lorenz | 62/153 |
| 3,696,360 | 10/1972 | Gajewski | 73/336.5 X |
| 3,820,398 | 6/1974 | Rekai | 73/336.5 |
| 3,859,502 | 1/1975 | Heaney | 62/275 X |
| 3,911,245 | 10/1975 | O'Shaughnessy | 62/150 X |
| 4,048,520 | 9/1977 | Muskovac | 307/311 X |

*Primary Examiner*—Albert J. Makay
*Assistant Examiner*—William E. Tapolcai, Jr.
*Attorney, Agent, or Firm*—Dressler, Goldsmith, Shore, Sutker & Milnamow, Ltd.

[57] ABSTRACT

An input control system having a sensing circuit, a switching circuit and a source of power isolated from the sensing circuit and the switching circuit. The sensing circuit includes a sensor having a variable electrical characteristic, a detector for detecting variations in that characteristic and for producing a representative output, a signal producing circuit for producing a predetermined signal in response to the detector output achieving a selected value, and coupler responsive to the predetermined signal to produce a coupling output. The switching circuit which is isolated from the sensing circuit produces a switching signal in response to the coupling signal to operate a switch for connecting an electrical load to the power source.

10 Claims, 3 Drawing Figures

LOAD
110 VAC

INPUT CONTROL SYSTEM

This is a continuation of application Ser. No. 878,332, filed Feb. 16, 1978, now abandoned, which was a continuation of Ser. No. 718,804, filed Sept. 1, 1976, now abandoned.

BACKGROUND OF THE INVENTION

The present invention relates to energy input control systems, and in particular, to a condensate sensing and control system for preventing formation of condensation on a unit being monitored.

Examples of prior art techniques for detecting moisture content of the air, e.g., dew point, or relative humidity, and/or for controlling formation of condensate on surfaces being monitored are disclosed in U.S. Pat. Nos. 2,435,895; 2,687,035; 2,720,107; 2,733,549; 2,733,607; 2,904,,995; 2,975,638; 3,142,986; 3,293,901; 3,161,056; 3,166,928; 3,195,344; 3,195,345; 3,287,974; 3,416,356; 3,422,677; 3,460,352; 3,552,186; 3,599,862; 3,696,360; 3,859,502; and British Pat. No. 900,194. Continuously heating such components is not desirable because the heated surfaces may appear warm to the touch, and because that approach involves a substantial waste of energy. It has been recognized that it is only necessary to heat the exposed surfaces being monitored periodically to keep them sufficiently warm in view of existing conditions to prevent the formation of moisture and frost.

The necessity to selectively and intermittently control a variety of electrical loads often presents significant problems. For example, commercial refrigerated units, e.g., refrigerators and freezers, particularly commercial upright units located in retail stores, are typically enclosed with by glass doors with the products contained therein visible to the consumer.

Typically, metal framed glass doors are used in these units. From the retailers point of view, it is necessary to prevent formation of condensate on these units, not only for aesthetic reasons, but more importantly because condensate, e.g., moisture and/or frost, reduces visibility through the glass doors and, reduces sales.

To overcome this problem, a number of techniques have been utilized for heating the exposed portions of the refrigerated unit e.g., the door frame, the mullion, and/or the glass itself to preclude the formation of condensate.

A number of techniques have been developed for intermittently heating the exposed surfaces of refrigerated units in an attempt to prevent the formation of condensate and to keep the surface temperatures of the glass, the door frame, the outer frame, and the mullions just above that point at which formation of condensate commences. Some of these techniques include presetting a heater to operate intermittently, but according to the fixed cycle. Another approach is to sense the relative humidity in the room in which the unit is disposed and to turn on the heaters when the relative humidity exceeds a preselected value. However, formation of condensate on the surfaces of refrigerated units is a function not only of the relative humidity in the room, but also of the temperature in the room and of the temperature of the exposed surfaces of the units, said surface temperature being partially determined by the temperature within the refrigerated units. Sensing relative humidity alone does not provide sufficient information to minimize energy utilization while simultaneously precluding formation of moisture.

Another approach is to adjust the duty cycle of the heater manually. While this may suffice, it requires constant monitoring by store personnel since the formation of frost can vary as a function of the number of times the doors are opened and as a function of changes in ambient conditions. It is common, therefore, for such systems to be set at a level to insure prevention of frost on the unit under the worst conditions, resulting in wasted energy.

As a variation of the relative humidity sensors, there are systems which adjust the duty cycle as a function of the relative humidity-increasing the duty cycle of the heaters as relative humidity increases. Again, since the point at which condensate forms is a function of more than the relative humidity in the ambient atmosphere, such systems are often adjusted to operate with a longer duty cycle than is necessary in order to preclude formation of condensate.

One of the patents identified above, U.S. Pat No. 3,696,360, discloses an alarm for warning of impending condensation on an element being monitored. While the system disclosed in this system is designed to be responsive to the various conditions which affect formation of condensation, it is believed the circuit disclosed, which includes a sensor and a load would not provide the sensitivity or accuracy required to insure prevention formation of condensation at minimum energy levels. The sensor being in the same circuit as the load, the required safety for use in areas where the sensor is exposed to personnel is not present.

In order to properly insure against formation of condensate on the exposed surfaces of a refrigerated unit, any control system should utilize as input information all of the factors which determine the point at which condensate forms on the exposed surfaces of the unit. The factors that determine this point are the ambient temperature in the room, the ambient relative humidity and the temperature of the exposed surfaces of the unit being monitored. Any satisfactory system should be reliable, automatic, efficient, should effect operation of the heaters for the minimum amount of time necessary to prevent formation of condensate, and must be safe.

SUMMARY OF THE INVENTION

In accordance with the present invention there is provided a control system for controlling input energy to a load such as electric heaters connected to portions of a refrigerated unit, or other units where ambient conditions on opposite sides of a thermal barrier differ, which is responsive to all of the conditions which affect the formation of condensate on the surfaces being monitored.

A system in accordance with the present invention incorporates a sensor affixed to an exposed surface of the refrigerated unit, the sensor being responsive to the temperature of the surface, to the ambient temperature and to ambient relative humidity for initiating energization of the heaters to prevent formation of condensation on the surfaces of the refrigerator unit being monitored. When the sensor is exposed, it is also necessary, for safety purposes, that the sensor be electrically isolated so that inadvertent contact between personnel and the sensor cannot result in an unsafe condition.

The energy control system of the present invention provides a transducer or sensor suitably located to monitor the exposed surfaces of a refrigerated unit. The sensor is electrically isolated from the power circuit connected to electric heaters, and accurately and reliably detects the point at which condensate forms on the unit and controls operation of heaters to prevent formation of condensation on the exposed surfaces being monitored.

More specifically, a variable resistive element is affixed to the exposed surfaces of a refrigerated unit in a manner that the temperature of the variable resistor exposed to ambient conditions varies in accordance with the temperature of the exposed surfaces of the unit. Thus, moisture on the surface of the sensor can be indicative of the conditions on the surfaces of the unit being monitored, and may be utilized to control operation of heaters to maintain the unit surfaces at a temperature just above that at which condensate forms with a minimum expenditure of energy.

In accordance with the present invention, the sensor includes a plurality of exposed spaced apart conductors embedded in an electrically insulated body which, in turn, is mounted on a thermally conductive member suitably affixed to or mounted on a surface of the unit. A signal is applied across the resistive element, the resistance of which varies in accordance with the amount of moisture on its surface, moisture altering the conductivity between the spaced conductors. A peak detector circuit is connected to the variable resistance transducer to produce a signal having an amplitude representative of the peak signal across the transducer which, in turn, varies as a function of the resistance of the transducer.

Since the resistance of the transducer varies as a function of the moisture formation on its surface, the detected signal has an amplitude which varies in accordance with the monitored condition, i.e., the incipient formation of condensate. This detection signal is applied to one input of a differential amplifier which produces an output of selected magnitude when the difference between the detection signal and a constant reference signal reaches a preselected magnitude.

This control output is terminated when the difference between the detection signal and the reference signal drops to a value less than the value required in initiate the output by a selected amount. The control output energizes a light emitting diode for producing a coupling signal.

A photo transistor is responsive to the light emitted by the light emitting diode to produce a switching signal in response to those emissions which is applied to the control electrode of an electronic switching element connected in series between a source of energy and a load being controlled. When monitoring a refrigerated unit, the load may be a plurality of resistance heaters appropriately located to raise the temperature of the exposed surfaces to preclude formation of condensate on those surfaces.

When the temperature of the exposed surfaces rises, in response to energization of the heaters, above the temperature at which moisture forms, the temperature of the sensor also rises causing moisture to evaporate from its surface. The resulting increase in the resistance of the sensor terminates the control output.

Emissions from the light emitting diode terminate, the switching signal from the phototransistor terminates and the signal applied to the control electrode of the switching element is thus ended. The switching element opens and the heaters one deenergized until the incipient formation of condensate is again detected on the surface of the sensor.

A system in accordance with the present invention provides efficient, accurate and reliable monitoring of the condensate formation or other conditions to be monitored, utilizes the minimum amount of energy necessary to maintain the desired condition, and at the same time provides the necessary safety by isolating the exposed sensor to prevent electrical hazards.

Numerous other advantages and features of the present invention will become readily apparent from the following detailed description of the invention and of one embodiment thereof, from the claims and from the accompanying drawing in which each and every detail shown in fully and completely disclosed as a part of this specification in whch like numerals refer to like parts.

DESCRIPTION OF THE PREFERRED EMBODIMENT

Figure 1:
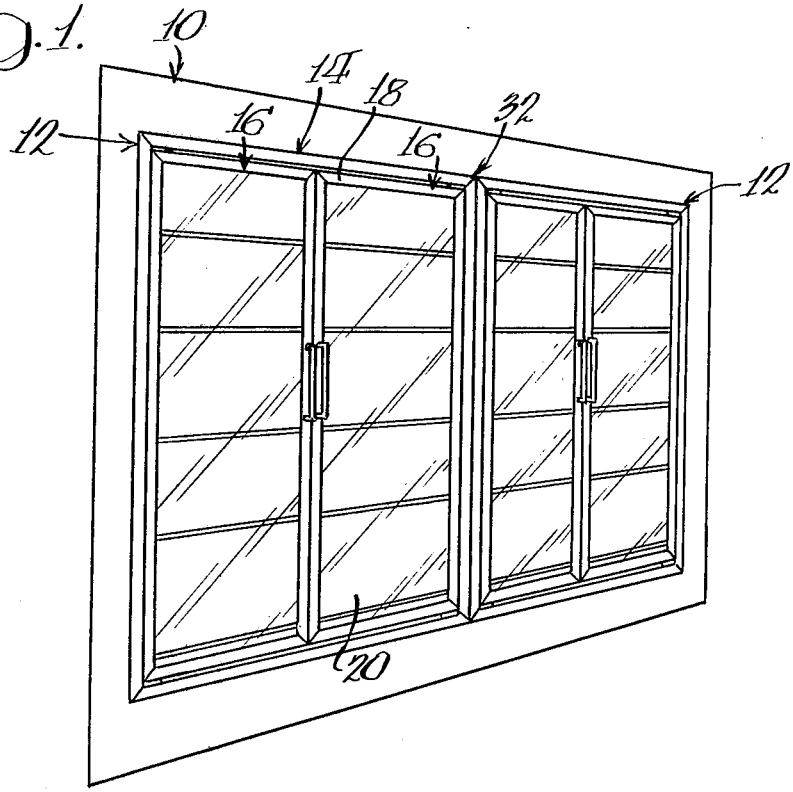
FIG. 1 is a perspective view of a refrigerated unit with which the system of the present invention may be used.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated. The scope of the invention will be pointed out in the appended claims.

FIG. 1 illustrates the front of refrigerated unit 10 incorporating a pair of door assemblies 12 mounted side by side in the unit 10 to provide a large area for the display and viewing of merchandise contained in the unit 10. Each door assembly 12 comprises a stationary mounting frame 14 and a pair of pull doors 16, adapted to close the opening in the stationary frame 14. Each of the doors 16 is of the type which includes a metal frame 18 in which a transparent panel 20 is mounted so that merchandise in the refrigerated unit will be clearly visible to customers. Typically, the transparent panel 20 is made of glass. The frame 14 of the unit, the door frame 18, the transparent glass panel 20 and other surfaces of the unit, e.g., mullions, are typically heated by resistive heaters to preclude the formation of condensate thereon.

The input control system of the present invention when used in conjunction with a refrigerated unit such as the type shown in FIG. 1 monitors the conditions at exposed surfaces of the unit and controls operation of electric heaters to preclude formation of condensate on such surfaces while utilizing the minimum amount of energy required to accomplish that purpose.

Figure 2:
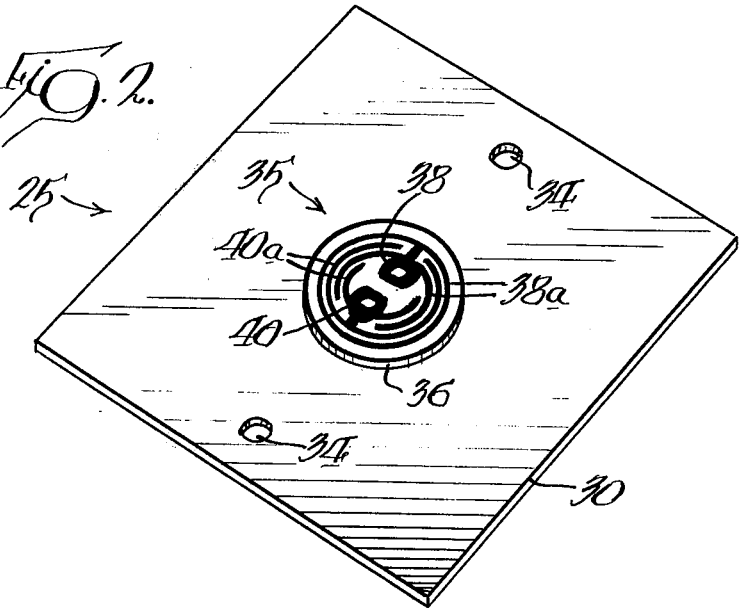
FIG. 2 is a perspective view of a sensor assembly for use in the system of the present invention.

A system incorporating the present invention, incorporates a sensor assembly 25, shown in FIG. 2. The sensor assembly 25 includes a thermally conductive support plate 30 which is affixed to an exposed surface of the refrigerated unit, e.g., to the mullion at 32 in FIG. 1, and is maintained in surface to surface contact therewith. The support plate 30 may be affixed to the mullion 32 by metallic fasteners such as screws (not shown)

which pass through the apertures 34 in the support plate 32 into the mullion to insure maximum thermal conductivity between the plate 32 and that portion of the refrigerated unit 10 to which it is affixed. In one embodiment, the support plate is made of aluminum, is approximately one inch square and 1/32 inch thick.

The sensor unit 35 is affixed to the surface of the support plate 32. The sensor unit 35 comprises an electrically insulative disk 36 which in the illustrated embodiment is a 1/32 inch thick epoxy glass disc. A pair of spaced conductors 38, 40 are formed on the surface of the disc 36 which, in the illustrated embodiment, include interleaved generally circular conductive fingers 38*a*, 40*a* spaced apart from each other and electroplated with an anticorrosive conductive element such as nickel plate and with a low contact resistance material such as gold.

In the illustrated embodiment, the insulated support disc 36 affixed to the support plate 30 is a 1/32 inch thick epoxy glass disc on which is photoprinted a one-half ounce copper pattern defining the spaced contacts 38, 40. The surface of the copper 4 is electroplated with a 0.00005 inch anti-corrosive layer of nickel plate which is electroplated with a 0.00003 inch thick low contact resistance layer of gold.

Figure 3:
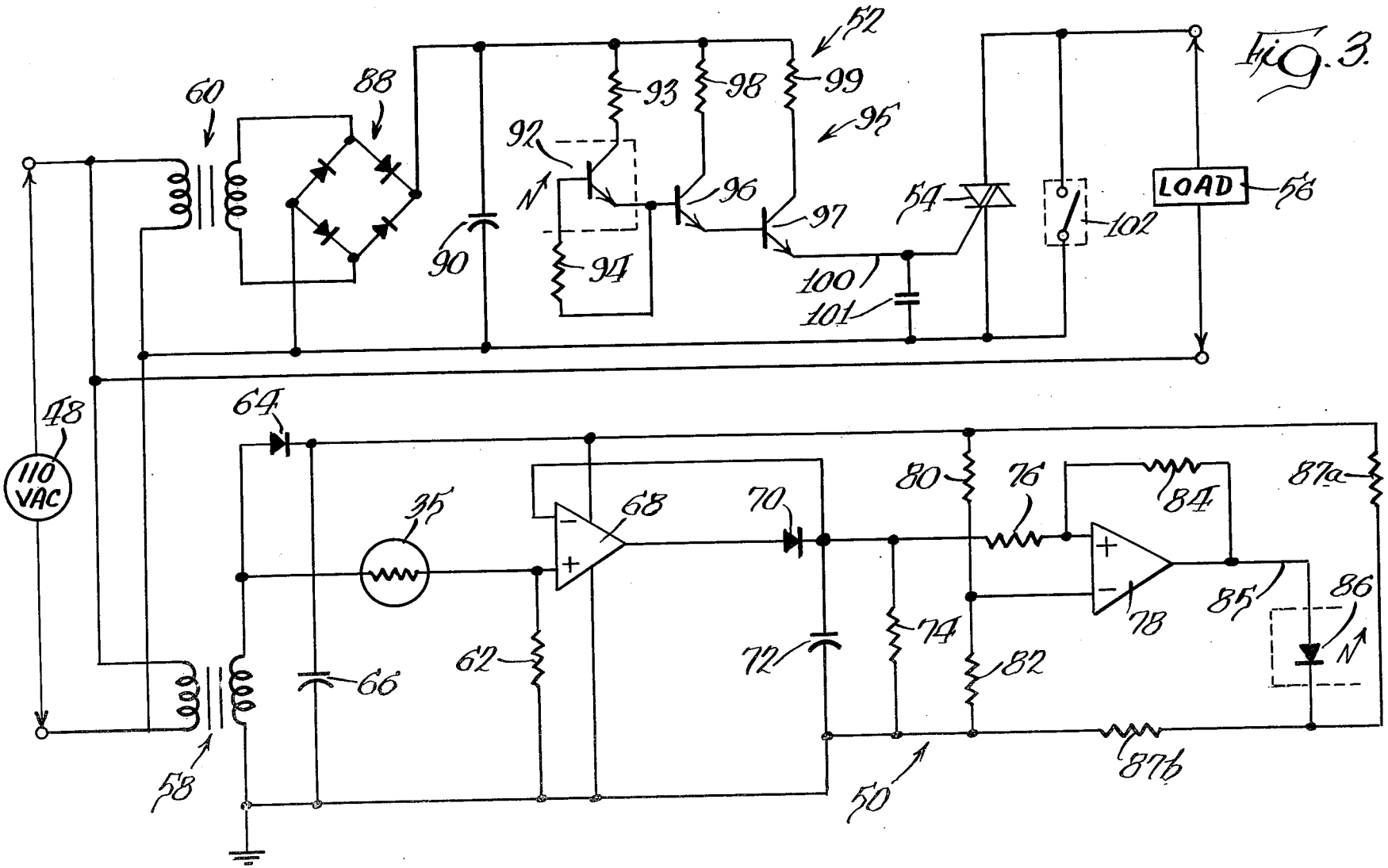
FIG. 3 is a circuit diagram of a system incorporating the present invention.

The sensor 35 forms part of the input control system shown in FIG. 3. The system of FIG. 3 includes a source 48 of ac potential, typically a 110 volt ac power line. The system includes a sensing circuit 50 and a switching circuit 52 responsive to operation of the sensing circuit 50 for operating an electronic switch 54 to connect a load 56, e.g., the resistive heaters, directly to the ac power source 48.

Since the control system of the present invention controls the energization of the load 56 by selectively connecting it directly to a 110 volt source 48 and since the sensor 35 which forms a part of the control system is located on exposed surfaces of a refrigerated unit which is being monitored, an electrical shock hazard could exist unless the system including the sensor 35 is isolated both from the load 56 and from the source 48. Isolation is further beneficial in that the energizing and deenergizing of the load does not affect the performance of the system in sensing incipient formation of condensation and precluding formation of condensation on the unit being monitored.

Accordingly, both the sensing circuit 50 and the switching circuit 52 are coupled to the power source 48 through isolating step down transformers 58, 60, respectively, the primaries of which are connected across the ac source 48. The secondary of the sensing circuit transformer 58 produces a twelve 25 mA output which is applied across a voltage divider consisting of the resistive sensor 35 and a second resistor 62 connected in series across the secondary of the sensing circuit transformer 58. This secondary voltage is also applied across a rectifier 64 and filter capacitor 66 to produce a d.c. control voltage and reference voltage. The junction between the resistive sensor 35 and the voltage divider resistor 62 is connected to the plus input of an operational amplifier 68.

The output of amplifier 68 is fed back to the negative input of amplifier 68 through rectifier 70. The operational amplifier 68 acts as a peak detector and produces a dc output which is integrated by capacitor 72 and resistor 74 and is applied through an input resistor 76 to the positive terminal of a second operational amplifier 78 which acts as a differential amplifier. The other input to the differential amplifier 78 is connected to the junction of a pair of voltage divider resistors 80, 82. The output of the differential amplifier is fed back to the positive input through a feedback resistor 84.

When the resistance of the resistive sensor 35 drops to a selected value, as determined by the value of the input voltage divider resistor 62 to the peak detector amplifier 68, the output of the peak detector will exceed the reference voltage sufficiently to cause the differential amplifier to produce an output signal 85. This output is applied to a light emitting diode (LED) 86 which produces light emission in response to this signal.

When the resistance of the sensor 35 rises as moisture evaporates from the surface thereof, the differential amplifier 78 terminates its signal when the level of the output of the peak detector 68 achieves a second value lower than the amplitude which initiated the output signal. This hysteresis characteristic minimizes continuous system oscillation. Resistors 87*a* and 87*b* acts as a voltage divider to insure that the LED turns off in the absence of signal 85. The value selected for discontinuing the output signal 85 is such as to deenergize the load 56, when desired, i.e., turn off the electric heaters when they have been on sufficiently long to insure the refrigerated unit has reached a temperature that precludes formation of condensate.

The switching circuit 52 includes the switching transformer 60, the secondary of which produces of 4.5 volt 250 mA signal rectified in a full wave receifier 88 and filtered by a filter capacitor 90 as is well known. The rectified output provides a source of power for a phototransistor circuit including phototransistor 92 and resistors 93 and 94 and for an amplifier circuit 95 which includes a pair of transistors 96, 97 and resistors 98, 99 connected to the output of the phototransistor 92. The phototransistor 92 produces a signal at its emitter in response to light emitted by the LED 86 which signal is amplified by the amplifier circuit 95. The output 100 of the amplifier circuit 95 is applied to a gate electrode of the electronic switch 54, a triac. A capacitor 101 is connected across the gate electrode to minimize transients.

The main electrodes of the triac 54 are connected in series with the power source 48 and the load 56. The triac 54 closes in response to the output 100 of the switching amplifier 95 in response to emissions from the LED 86. The optical coupling between the sensing circuit 50 and the switching circuit 52 isolates the sensor 35 from the load 56 to positively insure safety and insure that the sensor may in no way be connected across the 110 volt line.

A manual switch 102 may be connected across the triac 54 for the purpose of testing and manual operation of the heaters when desired.

In operation, when condensate begins to form on the surface of the sensor 35, the resistance between the pair of spaced electrodes drops, until, in the illustrated embodiment, the resistance achieves a level of 2 meg-ohms ±5%. The amplitude of the output of the peak detector 68 increases to cause the differential amplifier 78 to produce a signal 85 which energizes the LED 86.

The phototransistor 92 responds to the light emitted by the LED 86 to produce a signal amplified in the switching amplifier 95 to close the triac switch 54 and energize the load 56.

As the surface of the refrigerated unit begins to rise, so does the temperature of the sensor 35. Moisture evaporates from the surface of the sensor 35 causing an increase in its resistance thereby reducing the amplitude of the output of the peak detector 68. When the resistance of the sensor increases sufficiently, the amplitude of the output of the peak detector 68 drops to a value which terminates the signal 85 produced by the differential amplifier 78 to deenergize the LED 86, thereby terminating the output of the phototransistor 92 and causing the triac switch 54 to open. The load 56 is deenergized. Formation of condensate has been precluded. The load remains deenergized until such time as the condensate again begins to form on the surface of the sensor 35 causing its resistance to drop to a value sufficiently low to trigger the system once again.

Thus there has been disclosed a condition responsive input control system for sensing a condition to be monitored, for providing a switching signal to control a load related to that condition in which the sensor, the sensing circuit and the switching circuit are all isolated from the load and from any power source required to operate the load. The system in accordance with the present invention is safe, accurate, reliable, simple and self-contained, and is adapted to be automatically responsive to a variety of factors which may effect the condition to which the system is designed to respond.

In the circuit shown in FIG. 3, the following components have been used satisfactorily:

| | | |
|---|---|---|
| Diode 64 - IN4006 | | |
| Bridge 88 - each IN4006 | | |
| Diode 70 - IN4446 | | |
| Capacitor 66 | 220uf 25v | |
| Capacitor 72 | 1uf 25v | |
| Capacitor 90 | 1000uf 10v | |
| Capacitor 102 | 0.05uf 10v | |
| Resistor 62 | 2 meg ohm | 1% |
| Resistor 74 | 2 meg ohm | |
| Resistor 76 | 47 k ohm | |
| Resistor 80 | 100 k ohm | 1% |
| Resistor 82 | 100 k ohm | 1% |
| Resistor 84 | 2 meg ohm | |
| Resistor 87a | 15 k ohm | |
| Resistor 87b | 2 k ohm | |
| Resistor 93 | 270 ohm | |
| Resistor 94 | 10 meg ohm | |
| Resistor 98 | 100 ohm | |
| Resistor 99 | 10 ohm | 1 watt |
| Operational Amplifiers 68, 78 - each ½ LM1458 | | |
| LED 86 and phototransistor 92 - OPI5000 | | |
| Triac 54 - SPT225 | | |
| Transistors 96 and 97 - 2N3569 | | |

From the foregoing, it will be observed that numerous variations and modifications may be effected without departing from the true spirit and scope of the novel concept of the invention. It is, of course, intended to cover by the appended claims all such modifications as fall within the scope of the claims.

What is claimed is:

1. In a refrigerated unit, a dew point sensing system for controlling operation of electrical heating means for the refrigerated unit to preclude formation of condensation on the exposed surfaces of said refrigerated unit comprising:

resistive transducer means affixed to an exposed surface of said refrigerated unit and having a surface temperature which varies with the temperature of said unit, said transducer means comprised of an electrically insulated member mounted on a thermally conductive member in contact with said refrigerated unit, and a plurality of spaced apart electrically conductive members supported by said electrically insulated member and exposed to the ambient air surrounding said refrigerated unit;

the resistance of said transducer varying as a function of condensation formed on the surface thereof;

a source of alternating current;

means coupled to said source for applying an ac voltage across said resistive transducer means and for electrically isolating said resistive transducer means from said source;

operational amplifier means connected to said variable resistive transducer means for producing a detection output having an amplitude representative of the maximum amplitude of the voltage across said resistive transducer means;

differential amplifier means connected to receive said detection output and producing a signal having a constant amplitude in response to the amplitude of said detection output achieving a selected value, and terminating said signal in response to said detection output achieving a second value lower than said selected value light emitting diode means connected to the output of said differential amplifier for emitting light in response to said constant amplitude signal;

phototransistor means electrically isolated from said light emitting diode for producing a control signal in response to light emitted from said light emitting diode;

a semiconductor switch having its main electrodes connected in series between said source of electrical energy and electrical heating means and having a control electrode connected to the output of said phototransistor means for connecting said source to said electrical heater means in response to said control signal;

whereby said electrical heating means in energized.

2. A system as claimed in claim 1 wherein:

said operational amplifier produces said detection output having said selected value in response to a drop in the resistance of said transducer to a value indicative of the incipient formation of condensation, whereby said electrical heating means is energized to preclude formation of condensation on the exposed surfaces of said refrigerated unit.

3. A dew point sensing system for controlling operation of electrical heating means for a refrigerated unit to preclude formation of condensation on the exposed surfaces of said refrigerated unit comprising:

transducer means affixed to an exposed surface of said refrigerated unit and having a surface temperature which varies with the temperature of said refrigerated unit, said transducer being exposed to the ambient air surrounding said refrigerated unit and having an electrical characteristic varying as a function of condensation formed on the surface thereof;

a source of electrical power; means coupled to said source for applying a voltage across said transducer means and for electrically isolating said transducer means from said source;

means connected to said transducer means for producing a detection output having a characteristic representative of the value of the variable characteristic of said transducer means, including operational amplifier means for producing said detection output having an amplitude representative of the maximum amplitude of the voltage across said resistive transducer means;

means responsive to said detection output for producing a predetermined signal in response to the characteristic of said detection output achieving a selected value;

coupling means responsive to said predetermined signal for producing a coupling control signal electrically isolated from said predetermined signal; and switching circuit means responsive to said isolated coupling control signal for connecting said source to said electrical heating means;

whereby said electrical heating means is energized.

4. A sensing system as claimed in claim 3 wherein:

said transducer means comprises a resistive transducer the resistance of which varies as a function of condensation formed on the surface thereof.

5. A sensing system as claimed in claim 4 wherein:

said resistive transducer means comprises an electrically insulating member mounted on a thermally conductive member in contact with said refrigerated unit, and a plurality of spaced apart electrically conductive members supported by said electrically insulating member and exposed to the ambient air surrounding said refrigerated unit.

6. A system as claimed in claim 3 wherein:

said means responsive to said detection output includes differential amplifier means for producing a said predetermined signal having a constant amplitude in response to the amplitude of said detection output achieving said selected value.

7. A system as claimed in claim 6 wherein:

said differential amplifier means terminates said predetermined signal in response to the amplitude of said detection output achieving a second value lower than said selected value.

8. A system as claimed in claim 7 wherein:

said coupling means includes means for producing an optical signal in response to said predetermined signal and means electrically isolated from said optical signal producing means for producing said coupling control signal in response to said optical signal.

9. A system as claimed in claim 3 wherein:

said operational amplifier means produces said detection output having said selected amplitude in response to a drop in the resistance of said transducer means to a value indicative of the incipient formation of condensation on the surface of said transducer means whereby electrical heating means is energized to preclude formation of condensation on the exposed surfaces of said refrigerated unit.

10. A dew point sensing system for controlling operation of electrical heating means for a refrigerated unit to preclude formation of condensation on the exposed surfaces of said refrigerated unit comprising:

transducer means affixed to an exposed surface of said refrigerated unit and having a surface temperature which varies with the temperature of said refrigerated unit, said transducer being exposed to the ambient air surrounding said refrigerated unit and having an electrical characteristic varying as a function of condensation formed on the surface thereof;

a source of electrical power; means coupled to said source for applying a voltage across said transducer means and for electrically isolating said transducer means from said source;

means connected to said transducer means for producing a detection output having a characteristic representative of the value of the variable characteristic of said transducer means;

means responsive to said detection output for producing a predetermined signal in response to the characteristic of said detection output achieving a selected value and for terminating said predetermined signal in response to said characteristic of said detection output achieving a second value different from said selected value;

coupling means responsive to said predetermined signal for producing a coupling control signal electrically isolated from said predetermined signal; and switching circuit means responsive to said isolated coupling control signal for connecting said source to said electrical heating means; whereby said electrical heating means is energized.

* * * * *